US008957291B1

(12) United States Patent
Nelson

(10) Patent No.: US 8,957,291 B1
(45) Date of Patent: Feb. 17, 2015

(54) NECK JOINT CONSTRUCTION FOR STRINGED MUSICAL INSTRUMENT

(71) Applicant: Gregg A. Nelson, Duluth, MN (US)

(72) Inventor: Gregg A. Nelson, Duluth, MN (US)

( * ) Notice: Subject to any disclaimer, the term of this patent is extended or adjusted under 35 U.S.C. 154(b) by 0 days.

(21) Appl. No.: 14/040,809

(22) Filed: Sep. 30, 2013

(51) Int. Cl.

| | |
|---|---|
| ***G10D 3/00*** | (2006.01) |
| ***G10D 3/06*** | (2006.01) |
| ***G10D 1/00*** | (2006.01) |
| ***B27M 3/00*** | (2006.01) |

(52) U.S. Cl.
CPC ..... *G10D 3/06* (2013.01); *G10D 1/005* (2013.01); *B27M 3/0066* (2013.01)
USPC ..... 84/291; 84/293

(58) Field of Classification Search
CPC ..... G10D 3/06; G10D 1/005
See application file for complete search history.

(56) References Cited

U.S. PATENT DOCUMENTS

| | | | | |
|---|---|---|---|---|
| 508,858 | A * | 11/1893 | Back | 84/294 |
| 600,507 | A * | 3/1898 | Bremerman | 84/293 |
| 1,707,192 | A * | 3/1929 | Overton | 84/267 |
| 2,469,582 | A * | 5/1949 | Strong | 84/293 |
| 3,424,048 | A * | 1/1969 | Mack et al. | 84/290 |
| 4,793,236 | A | 12/1988 | McGuire et al. | |
| 4,803,906 | A | 2/1989 | Fender | |
| 4,856,403 | A * | 8/1989 | Davies | 84/291 |
| 4,982,640 | A | 1/1991 | Buscarino | |
| 5,305,819 | A | 4/1994 | Boulanger et al. | |
| 5,406,874 | A * | 4/1995 | Witchel | 84/291 |
| 5,886,272 | A | 3/1999 | Regenberg | |
| 6,194,645 | B1 | 2/2001 | Rose | |
| 7,041,889 | B1 * | 5/2006 | Hsieh | 84/291 |
| 7,081,575 | B1 * | 7/2006 | Pieper et al. | 84/293 |
| 7,476,790 | B2 * | 1/2009 | Breedlove et al. | 84/293 |
| 7,893,328 | B1 * | 2/2011 | Rigaud et al. | 84/267 |
| 7,932,448 | B1 * | 4/2011 | Bochar, Jr. | 84/267 |
| 8,426,709 | B2 | 4/2013 | Zervas et al. | |
| 2003/0010181 | A1 * | 1/2003 | Takeuchi | 84/293 |
| 2011/0232458 | A1 | 9/2011 | Altheim | |

* cited by examiner

*Primary Examiner* — Robert W Horn
(74) *Attorney, Agent, or Firm* — Thomas E. Lees, LLC

(57) ABSTRACT

A stringed musical instrument comprises a neck, a body and a neck joint. The neck has a heel comprising at least a wedge. Correspondingly, the body has a heel slot at a neck joint location along an upper bout of the body. The heel slot is complementary to the heel of the neck and includes a shaped pocket that corresponds with the wedge of the neck. The neck is attached to the body such that the wedge engages the shaped pocket of the heel slot and the neck is fixed to the body, e.g., using an adhesive.

20 Claims, 8 Drawing Sheets

NECK JOINT CONSTRUCTION FOR STRINGED MUSICAL INSTRUMENT

BACKGROUND

The present disclosure relates in general to stringed musical instruments, and in particular, to neck construction for a stringed musical instrument that incorporates a generally V-shaped locking mechanism.

Stringed musical instruments such as electric guitars and electric basses are widely used in the performance of modern popular music. A typical stringed musical instrument includes a body, a neck extending from the body, and a headstock situated at the end of the neck. A set of strings span between a bridge located on the body and a nut located on the neck adjacent to the headstock. When strummed, plucked, picked or otherwise stroked, the strings vibrate producing sound.

Presently, stringed musical instruments are produced in various body and neck configurations. For instance, to expedite the manufacturing process, an instrument body can be manufactured separately from a corresponding neck. During assembly, the neck is joined to the body.

BRIEF SUMMARY

According to aspects of the present disclosure, a method of attaching a neck to a body of a stringed musical instrument is provided. The method comprises forming a heel of the neck. The heel (also referred to herein as a tang) is formed so as to include at least a wedge. The method also comprises forming a heel slot at a neck joint location along an upper bout of the body. The heel slot is formed in a manner that is complementary to the heel of the neck and thus includes a shaped pocket that corresponds with the wedge of the neck. For instance, the wedge on the heel may be "V" shaped. In this regard, the heel slot of the body can include a V-shaped pocket that is configured to receive the V-shaped wedge of the heel. The method also comprises inserting the neck into the body such that the wedge engages the shaped pocket of the heel slot. Also, the method comprises securing the neck to the body, e.g., using an adhesive.

According to still further aspects of the present disclosure, a stringed musical instrument is provided. The stringed musical instrument comprises a neck and a body. In an exemplary construction, the neck is attached to the body using a neck joint that facilitates a rigid attachment. Particularly, the neck has a heel comprising at least a wedge. Correspondingly, the body has a heel slot at a neck joint location along an upper bout of the body. The heel slot is complementary to the heel of the neck and includes a shaped pocket that corresponds with the wedge of the neck. For instance, in a manner analogous to that set out above, the wedge on the heel may be "V" shaped. In this regard, the heel slot of the body can include a V-shaped pocket that is configured to receive the V-shaped wedge of the heel. The neck is attached to the body such that the wedge engages the shaped pocket of the heel slot and the neck to is fixed to the body, e.g., using an adhesive.

DETAILED DESCRIPTION

According to various aspects of the present disclosure, a stringed musical instrument is provided. The stringed musical instrument includes a body and a neck attached to the body by an improved neck joint that facilitates a rigid connection between the neck and body. The neck joint configuration herein facilitates significant energy and vibration transfer between the body and the neck, thus providing an instrument with extended sustain and improved integration of the neck and body components while still allowing the convenience of separate manufacture of the body and neck.

Aspects of the present disclosure herein further provide increased mating surface area between the body and the neck. By having multiple areas of contact, which are collectively configured in different planes and at different angles, a stable, solid and rigid connection is made between the body and the neck that allows for improved sound transfer and resonance between the body and neck as compared to traditional bolt on or set neck designs.

Figure 1:
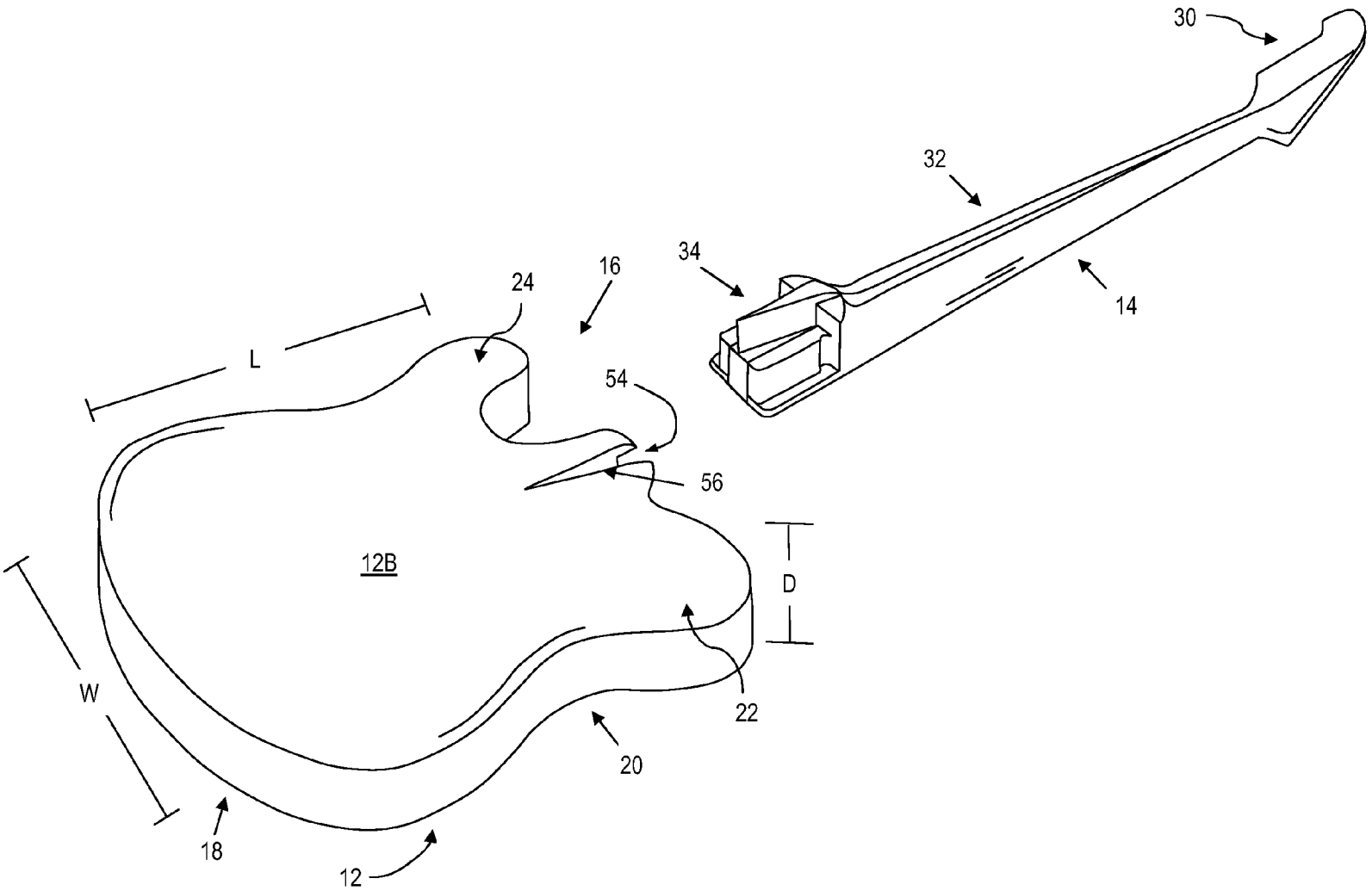
FIG. 1 is an orthographic view of a stringed musical instrument, according to aspects of the present disclosure.

Basic Instrument Construction:

Referring now to the drawings and in particular to FIG. 1, a stringed musical instrument 10 is illustrated, which incorporates an improved neck joint according to aspects of the present disclosure. The stringed musical instrument 10 includes in general, a body 12 and a neck 14. The neck 14 is joined to the body 12 using a neck joint as set out and described in greater detail herein.

The body 12, neck 14 and neck joint are described herein using general orientations that are utilized for convenience and clarity of discussion. Particularly, the stringed musical instrument 10 is defined with regard to a length (L) that extends in the direction of the major length of the neck 14, a width (W) that extends across a major surface of the body 12 in a direction perpendicular to the length (L) and a depth (D) corresponding to a thickness (or thicknesses) of the body 12 and neck 14.

The body 12 includes a front surface 12A (FIG. 3) and a back surface 12B. The view in FIG. 1 is looking towards the back surface 12B of the stringed musical instrument 10 for clarity of discussion of the neck joint. In general, the body 12 can take on any desired shape. However, for sake of example, the illustrated body 12 is conceptually divided into two general regions, including an upper bout 16 and a lower bout 18. The upper bout 16 is separated from the lower bout 18 by a waist 20 or narrowed/tapered region of the body 12.

The neck 14 divides the upper bout 16 into two sub-regions, including a top region 22, illustrated by a top horn and a bottom region 24 illustrated by a bottom horn. However, in practice, the upper bout 16 can take any desired shape. Correspondingly, the lower bout 18, i.e., the region from the waist 20 towards the end of the body 12, is shown as rounded for sake of convenience, but can take any desired shape.

As will be described in greater detail herein, the neck 14 may include a headstock 30. While not required, the headstock 30 is often utilized to perform one or more functions, such as to hold tuning keys, to provide access to a truss rod adjustment, to support string trees or other specific features of a particular implementation of the stringed musical instrument 10. Still further, the headstock 30 can be used to supply mass to the end of the neck 14, thus further improving vibration transfer between the body 12 and the neck 14.

The neck 14 also includes a neck section 32 that extends from the headstock 30, and a heel 34 that terminates at the end of the neck section 32 opposite the headstock 30. The heel 34 serves as a tang to couple the neck 14 to the body 12 of the stringed musical instrument 10, as will be described in greater detail herein.

Figure 2:
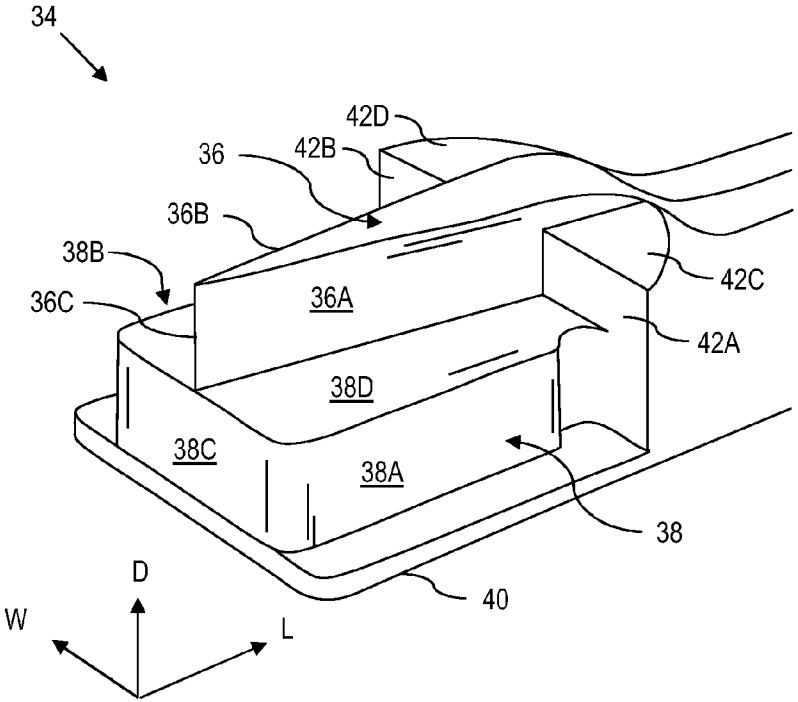
FIG. 2 is an orthographic view of a neck heel of the stringed musical instrument of FIG. 1, according to aspects of the present disclosure.

The Neck Joint:

Referring to FIG. 2, the heel 34 comprises at least a wedge 36. In general, the wedge 36 includes a thick, i.e., wide end that tapers to a thin, i.e., narrow end or edge. In this example, the wedge 36 is V-shaped and includes a first wedge wall 36A and a second wedge wall 36B that come together at a wedge apex 36C. The first wedge wall 36A and second wedge wall 36B define mating surfaces (i.e., surfaces that mate with the body 12) when the neck 14 is joined to the body 12. Although illustrated as a generally V-shaped wedge 36, in practice the wedge 36 can be V-shaped, tapered U-shaped (or blunt V) or other desired shape where the first wedge wall 36A and the second wedge wall 36B are not parallel along their entire length. Thus, in the illustrative example, the wedge 36 is not a purely rectangular block, but rather, a shape that converges to an apex. In practice, the wedge 36 can have more than two side walls. Moreover, the edges and/or side walls of the wedge 36 can be contoured, curved, straight, angled, etc., and need not mirror the corresponding edges.

In the illustrative but non-limiting example of FIG. 2, the heel 34 is a compound heel 34 as there is more than one distinct shape in the depth (D) dimension. More particularly, as illustrated, the heel 34 includes a block-shaped heel portion 38 that is situated between the wedge 36 and a fret board 40 of the neck 14. In this manner, the block-shaped heel portion 38 and the wedge 36 are stacked along the depth (D) of the neck 14. As illustrated, the block-shaped heel portion 38 includes a first bock wall 38A, a second block wall 38B opposite the first block wall 38A, and a third block wall 38C that connects the first block wall 38A to the second block wall 38B. The block-shaped heel portion 38 also includes a major surface 38D that the wedge 36 rests upon. The first bock wall 38A, second block wall 38B, third block wall 38C and major surface 38D also define mating surfaces when the neck 14 is joined to the body 12. Moreover, analogous to the wedge 36, the first bock wall 38A, second block wall 38B, third block wall 38C and major surface 38D can be contoured, curved, straight, angled, etc., and need not mirror the corresponding edges.

As will be described in greater detail herein, the heel 34 also includes other mating surfaces including pocket mating surfaces 42A, 42B, 42C and 42D.

Another way of visualizing the compound heel 34 is to note that the heel 34 of the neck 14 includes a plurality of "shelves" that are stacked in the depth dimension. In this regard, the compound heel 34 includes a first shelf, i.e., the wedge 36 at the back of the heel 34; a second shelf, i.e., the block-shaped heel portion 38 adjacent to the wedge 36 (e.g., above the wedge 36 when the neck 14 is oriented with the fretboard up) and a third shelf defined by the underside of the fret board 40 adjacent to the block-shaped heel portion opposite the wedge 36.

In general, the compound heel 34 need not precisely include a stack of a wedge and a block. Rather, other shapes (and/or additional shapes) may be utilized, depending upon the particular implementation.

Figure 3:
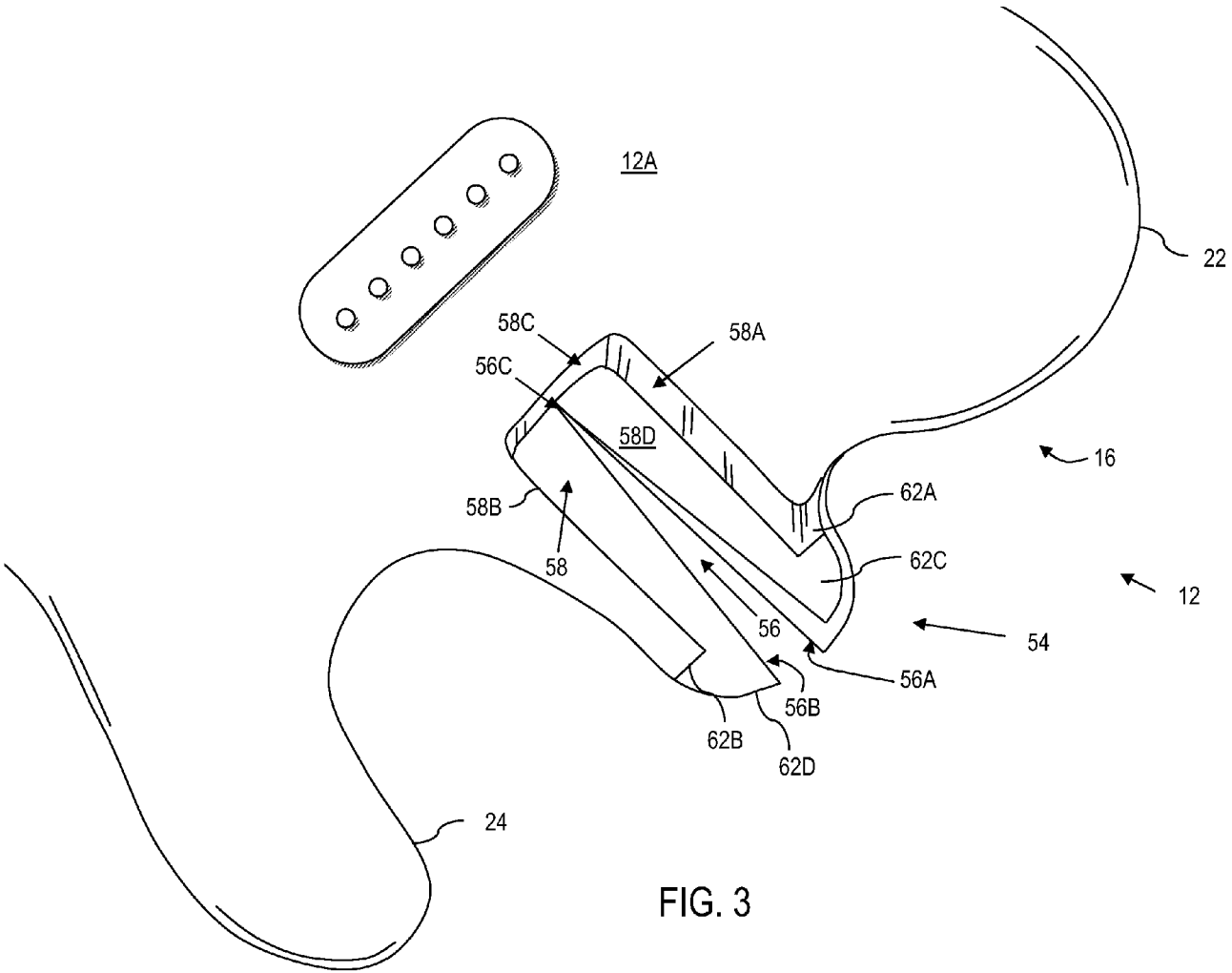
FIG. 3 is an orthographic view of a neck slot in the body of the stringed musical instrument of FIG. 1, according to aspects of the present disclosure.

Referring to FIG. 3 considered along with FIG. 1, the body 12 has a heel slot 54 at a neck joint location along the upper bout 16 of the body 12. For instance, as best illustrated with regard to FIG. 1, the heel slot 54 is situated between the top region 22 (top horn) and bottom region 24 (bottom horn) of the upper bout 16 and recesses into the body. Moreover, the heel slot 54 is complementary to the heel 34 of the neck 14. Thus, for instance, the heel 34 cooperates with the heel slot 54 to mate the neck 14 with the body 12, thus joining major components of the stringed musical instrument 10.

Referring particularly to FIG. 3, in an exemplary implementation, the heel slot 54 includes a shaped pocket that corresponds with the wedge 36 of the neck 14. For instance, as illustrated, the heel slot 54 includes a first (wedge) shaped pocket 56 that is complementary to the wedge 36 (FIG. 2). As illustrated, the first shaped pocket 56 is substantially V-shaped and includes pocket walls 56A and 56B that converge at an apex 56C. Moreover, as best illustrated with regard to FIG. 1, the first shaped pocket 56 extends through the back face 12B (FIG. 1) of the body 12. The first shaped pocket 56 is not required to extend entirely through to the back surface 12B of the body. However, by doing so, an aesthetic, ornamental feature is provided because the wedge 36 creates a triangular/"V" shape on the back surface 12B of the body 12, providing an ornamental appearance of a heel cap.

Referring back to FIG. 3, moreover, as will be described in greater detail herein, the heel slot 54 can include other features, depending upon the shape(s) and contour(s) of the heel 34. For instance, the heel slot 54 may also include a second shaped pocket 58, e.g., a generally rectangular pocket that is complementary to the block-shaped heel portion 38 (FIG. 2) in this example. In this example, the second pocket includes pocket walls 58A and 58B joined together by pocket wall 58C. Moreover, the second shaped pocket 58 includes a pocket major surface 58D.

Thus, the heel slot 54 extends from the front surface 12A into the body 12, and can pass entirely through the thickness (in the dimension D) of the body 12. Also, the second shaped pocket 58 extends downward from the top surface 12A of the body 12 into, but not through, the body 12. Likewise, the first shaped pocket 56 extends downward from the second shaped pocket 58, i.e., the first shaped pocket 56 and second shaped pocket 58 are stacked in the depth dimension.

Assembling the Neck to the Body:

During assembly, the neck 14 is attached to the body 12 such that the heel 34 engages the heel slot 54. Also, in the illustrative example, the wedge 36 engages the shaped pocket 56 of the heel slot 34. Moreover, the neck 14 is fixed to the body 12 using a suitable adhesive. For instance, the heel 34 of the neck 14 can be slid into the heel slot 54 of the body 12. The neck 14 (or correspondingly, the body 12) is then tapped, thus driving the wedge 36 into the first shaped pocket 56 of the heel slot 54. Depending upon the tolerances of the first shaped pocket 56 of the heel slot 54 and the dimensions of the wedge 36, it is possible that the surfaces 36A, 36B of the wedge 36 will contact the side walls 56A, 56B of the complementary first shaped pocket 56 before the apex 36C of the wedge 36 reaches the vertex 56C of the first shaped pocket 56. As such, ramming the body 12 and neck 14 into each other may be necessary to drive the wedge 36 to a position where the apex 36C of the wedge 36 seats neatly against the vertex 56C of the wedge shaped pocket.

Also, the block-shaped heel portion 38 seats into the second shaped pocket 58. More precisely, the block walls 38A, 38B and 38C mate against corresponding pocket walls 58A, 58B and 58C. Likewise, the major surface 38D of the block-shaped heel portion 38 mates against the major surface 58D of the second shaped pocket 58.

Still further, other parts of the neck joint contribute to the securement of the neck 14 to the body 12. For instance, the surfaces 42A and 42B of the heel 34 mate with corresponding surfaces 62A, 62B of the heel slot 54. Likewise, surfaces 42C, 42D of the heel 34 mate with corresponding surfaces 62C, 62D of the heel slot 54.

In this manner, the neck 14 can at rigidly attached to the body 12 using adhesive, but without requiring fastener(s), e.g., bolts, screws, etc., to attach the neck 14 to the body 12.

As illustrated, the heel 34 and corresponding heel slot 54 each include a number of different features. In this regard, once the heel 34 has been inserted into the heel slot 54 of the body 12, all mating features of the heel 34 mate with corresponding features of the heel slot 54. Moreover, the fingerboard 40 should be appropriately positioned relative to the body 12 for proper setup and intonation of the stringed musical instrument 10.

Figure 4:
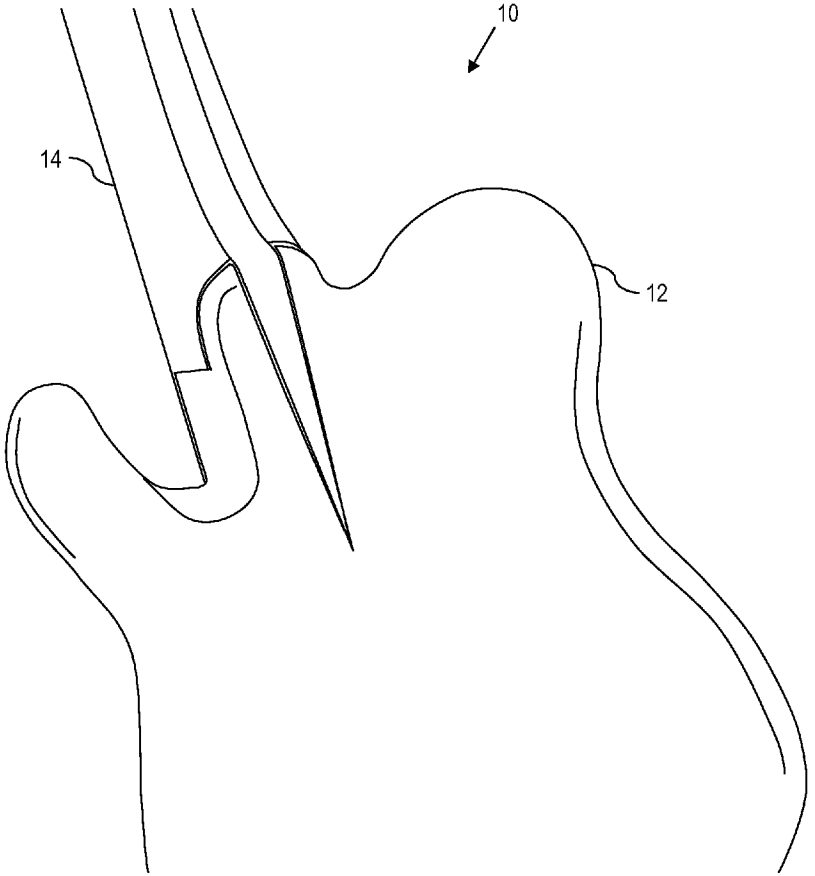
FIG. 4 is a view of a neck joined to a body of a stringed musical instrument, using a neck joint according to aspects of the present disclosure.

Referring to FIG. 4, the neck 14 is illustrated joined to the body 12 in a manner set out and described with reference to FIGS. 1-3.

Figure 5:
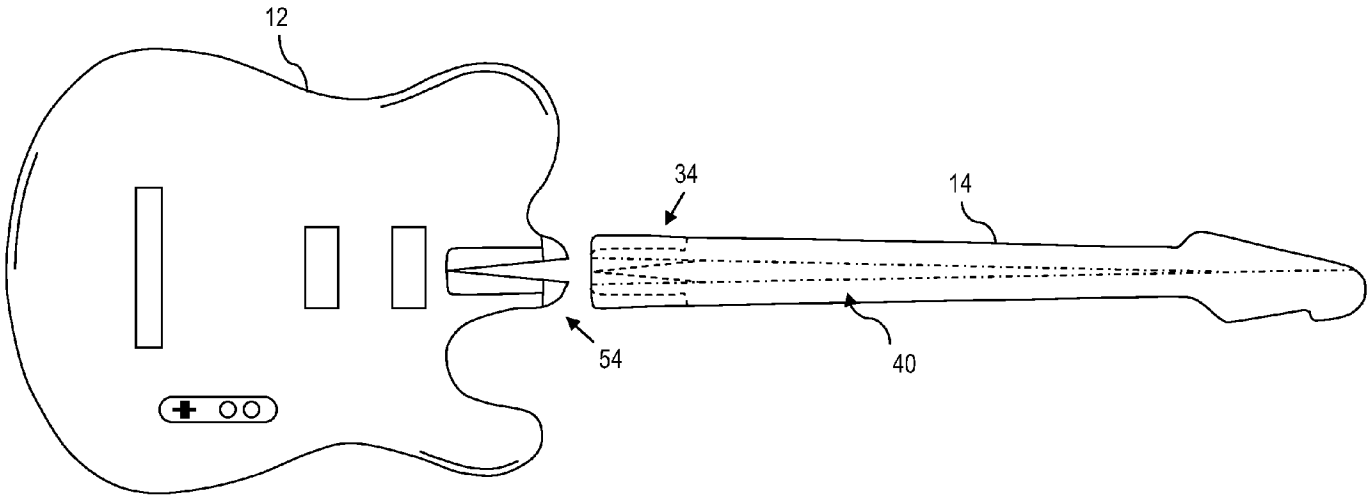
FIG. 5 is a view of the stringed musical instrument of FIG. 1, looking towards the front face of the instrument body, according to aspects of the present disclosure.

Referring to FIG. 5, a view illustrates the neck 14 separated from the body 12 to illustrate the heel 34 of the neck relative to the heel slot 54 of the body 12 looking at the top surface 12A of the body 12. As illustrated, the fret board 40 covers a top surface of the neck 14. However, frets are not illustrated solely for purposes of clarity of illustration. In practice, the fretboard 40 can be fretted or fretless.

Figure 6:
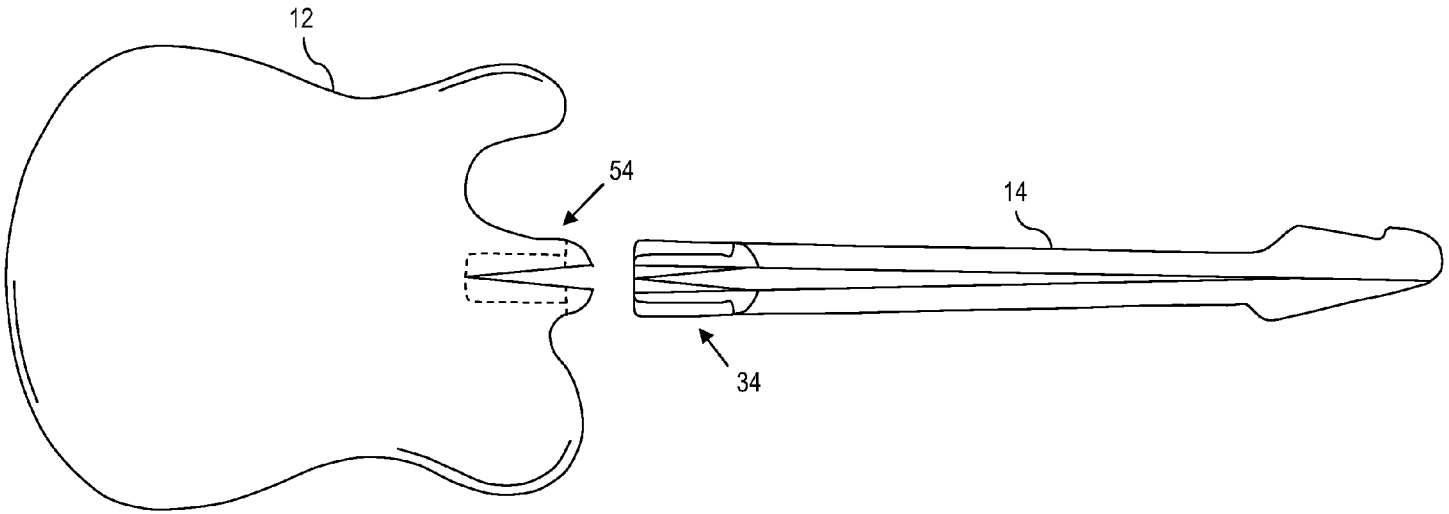
FIG. 6 is a view of the stringed musical instrument of FIG. 1, looking towards the back face of the instrument body, according to aspects of the present disclosure.

Referring to FIG. 6, a view illustrates the neck 14 separated from the body 12 to illustrate the heel 34 of the neck relative to the heel slot 54 of the body 12 looking at the bottom surface 12B of the body 12.

Figure 7:
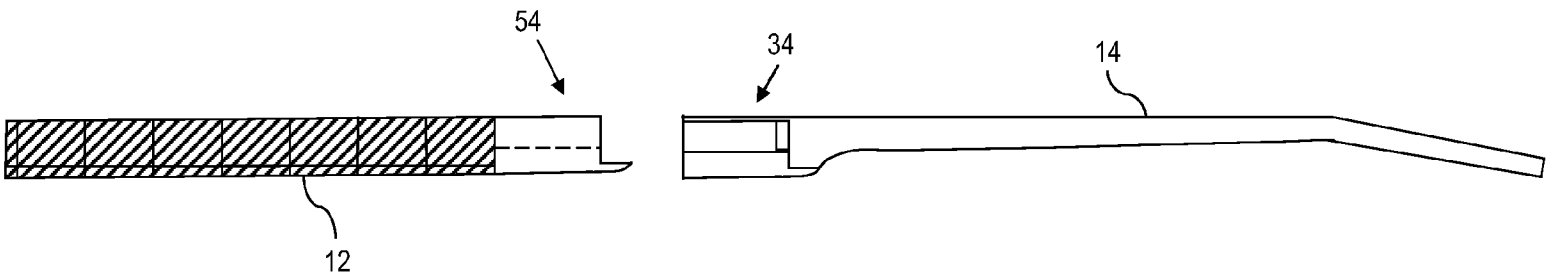
FIG. 7 is a view of the stringed musical instrument of FIG. 1, looking towards the side of the instrument body, according to aspects of the present disclosure.

Referring to FIG. 7, a view illustrates the neck 14 separated from the body 12 to illustrate the heel 34 of the neck relative to the heel slot 54 of the body 12 looking at the side of the body 12.

The above-neck joint provides a significant increase in surface area in the body 12 to neck 14 union compared to a conventional bolt-on necked instrument. Moreover, the increased surface area translates into an increased surface area for glue to bond the body 12 and neck 14.

This neck joint provides improved sound transfer and sustain, with improved strength and rigidity. This is achieved by using a finger joint design which greatly increases the surface mating areas which enhances the transfer of sound. Moreover, due to the different shapes in the stacked compound heel, there are a plurality of different mating surfaces at different angles and in different planes, this improving the rigidity of the neck attachment to the body, and in the strength of the joint between the body 12 and the neck 14.

Moreover, the finger joint as disclosed herein, allows for superior sound transfer and resonance by keeping the selected tonewood body in one piece. This construction is advantageous even over conventional through-neck designs because such through-neck designs separate the body 12 into multiple pieces that must couple to the neck, which separates and dampens sound transfer to the tonewood sides.

Additionally, wood filler, epoxy and other materials can be used to clean and dress the neck joint. Moreover, it may be desirable to make the neck slot 54 in the body either slightly smaller than the heel 34 or slightly larger than the heel 34, e.g., depending upon the particular construction.

Figure 8:
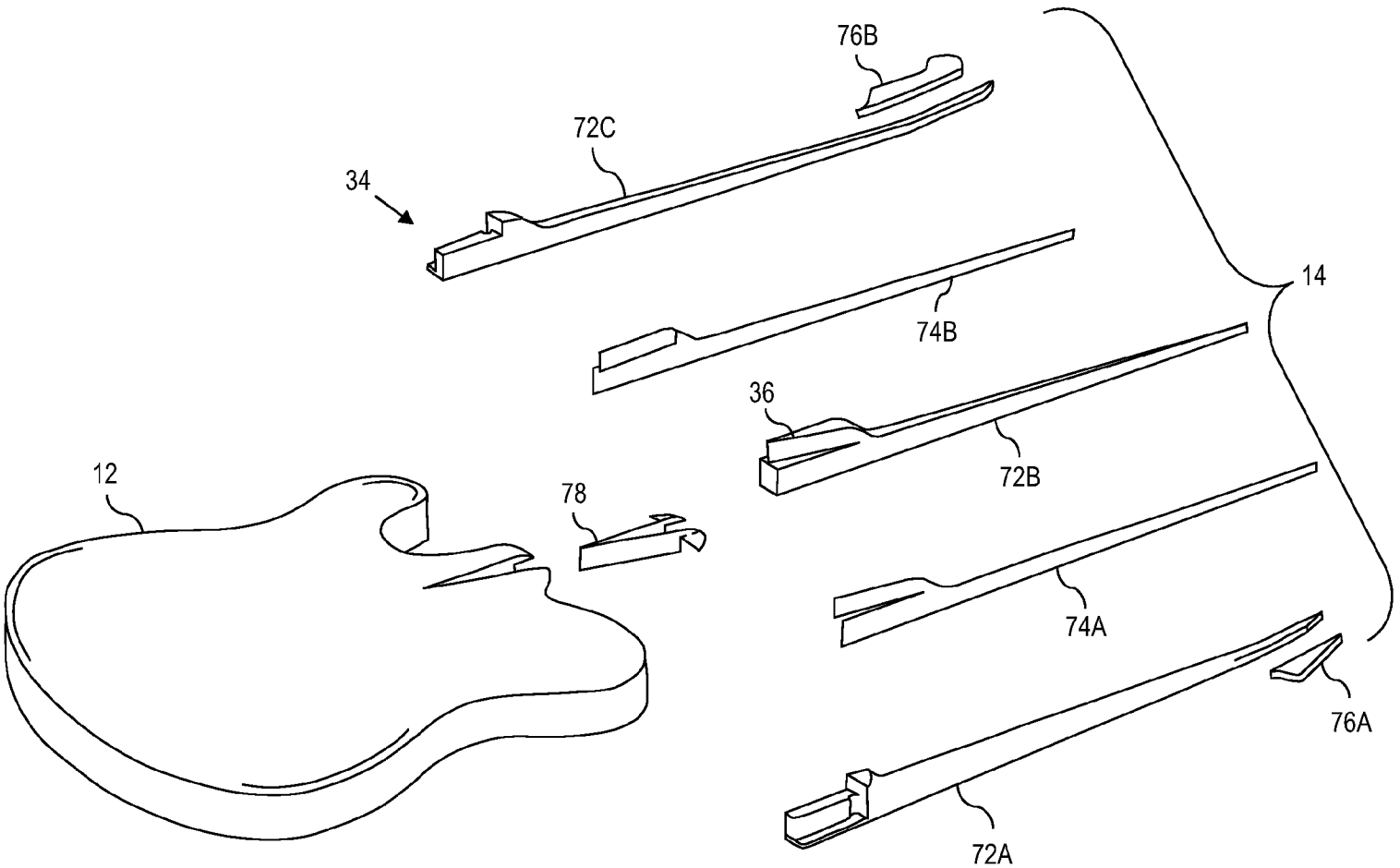
FIG. 8 is a view of a stringed musical instrument having a multi-construction neck and neck heel, according to aspects of the present disclosure.

Referring to FIG. 8, according to further aspects of the present disclosure, the neck 14 may comprise at least at least two neck profiles bonded together. In this implementation, one or more of the neck profiles combine to form the heel 34, such that when the neck profiles are assembled together, the neck is defined and at least one neck profile includes the wedge 36.

More particularly, the illustrated neck 14 comprises three neck profiles 72A, 72B, 72C (more generally, 72) and two veneer strips 74A, 74B (more generally, 74). The veneer strip 74A is sandwiched between the neck profiles 72A and 72B. Similarly, the veneer strip 74B is sandwiched between the neck profiles 72B and 72C. Thus, the neck 14 includes three neck profiles 72A, 72B, 72C with a veneer strip 74 situated between each adjacent pair of neck profiles. At least one neck profile 72A, 72B, 72C has a heel portion, such that when the neck profiles 72A, 72B, 72C are assembled together, the neck 14 is defined and at least one neck profile 72A, 72B, 72C defines the heel 34. In this manner, at least one neck profile 72A, 72B, 72C defines the wedge 36 and/or other features of the heel 34.

As noted above, the neck 14 may include a headstock. In this regard, in an illustrative implementation, at least one panel 76 is attached to an end neck profile 72 at an end of the neck opposite the heel 34 to define the headstock 30. For instance, a first panel 76A attaches to the first neck profile 72A and a second panel 76B attaches to the third neck profile 72C to collectively define the headstock 30. Moreover, the second neck profile 72B can extend out to define a portion of the headstock 30. In an exemplary configuration, a middle one of the neck profiles, e.g., the second neck profile 72B, may have a taper so as to be wider towards the heel and relatively more narrow towards an end opposite the heel at the area of the headstock. Also as shown, a veneer wing 78 is illustrated. The veneer wing can be used to dress the edges of the wedge 36.

As used herein, the stringed musical instrument 10 may comprise a guitar, bass guitar or other stringed musical instrument that includes a separate neck that is attached to an instrument body 12. For instance, in building a bass guitar, it may be desirable to use more than three neck profiles 72. For instance, five or more neck profiles 72 may be utilized to account for the desired width of the neck 14.

The neck joint is visible and visually appealing from the back side of the instrument. In this regard, the edges and any added veneer (e.g., the two veneer strips 74A, 74B and/or wing 78) are for aesthetics and thus provide ornamentation.

The finger joint or tang on the base of the neck 14 is wedged and mated to the body 12 by constructing a heel slot 54 (compound cavity) in the body 12. This cavity features multiples sleeves that receive the "shelves" of the tang so as to improve the overall strength of the neck joint, providing increased contact area and thus increases sound transfer and tonal characteristics.

Method of Attaching a Neck to a Body Using the Neck Joint Herein:

According to aspects of the present disclosure, a method of attaching a neck to a body of a stringed musical instrument is provided, which uses the neck joint described more fully herein. The method comprises forming a heel of the neck, where the heel includes at least a wedge. The method also comprises forming a heel slot at a neck joint location along an upper bout of the body, where the heel slot is complementary to the heel of the neck and includes a shaped pocket that corresponds with the wedge of the neck. The method also comprises inserting the neck into the body such that the wedge engages the shaped pocket of the heel slot and securing the neck to the body using an adhesive.

According to further aspects of the present disclosure, forming a heel slot comprises forming the heel slot so as to extend through the back face of the instrument body.

According to further aspects of the present disclosure, forming a heel further comprises forming a compound heel by forming a block-shaped heel portion, where the block-shaped heel portion is located between the wedge and a fret board of the neck such that block-shaped heel portion and the wedge are stacked. Here, the wedge can be substantially V-shaped. Correspondingly, the method comprises forming a compound heel slot in the body by forming a block-shaped pocket extending from the top surface of the body into but not through the body and forming a wedge shaped pocket (corresponding to the shape of the wedge) extending downward from the bottom of the block-shaped pocket towards the back surface of the body. For instance, forming a wedge shaped pocket may comprise extending a V-shaped pocket through the back surface of the body.

Still further aspects of the present disclosure further comprise forming the neck by assembling at least two neck profiles together, at least one neck profile having a heel portion, such that when the neck profiles are assembled together, the neck is defined and at least one neck profile includes the wedge. For instance, the neck may be implemented by assembling three neck profiles together with a veneer strip situated between each adjacent pair of neck profiles. In this construction, at least one neck profile has a heel portion, such that when the neck profiles are assembled together, the neck is defined by the neck profiles and at least one neck profile includes the wedge. As an example, the neck profiles can be constructed by forming a middle one of the neck profiles so as to have a taper so as to be wider towards the heel and relatively more narrow towards an end opposite the heel. The method may also comprise attaching at least one panel to an end neck profile at an end of the neck opposite the heel to define a headstock.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure.

Having thus described the disclosure of the present application in detail and by reference to embodiments thereof, it will be apparent that modifications and variations are possible without departing from the scope of the invention defined in the appended claims.

What is claimed is:

1. A method of attaching a neck to a body of a stringed musical instrument, the method comprising:

forming a heel of the neck, the heel comprising at least a wedge extending in a length direction along a major length of the neck, having an apex pointing away from the neck along the length direction;

forming a heel slot at a neck joint location along an upper bout of the body, the heel slot complementary to the heel of the neck and including a shaped pocket that corresponds with the wedge of the neck;

inserting the neck into the body such that the wedge engages the shaped pocket of the heel slot; and securing the neck to the body.

2. The method of claim 1, wherein:

forming a heel slot comprises forming the heel slot so as to extend through the back face of the instrument body.

3. The method of claim 1, wherein:

forming a heel further comprises:

forming a compound heel by forming a block-shaped heel portion between the wedge and a fret board of the neck such that block-shaped heel portion and the wedge are stacked; and forming a heel slot further comprises:

forming a compound heel slot by:

forming a block-shaped pocket extending from the top surface of the body into but not through the body; and forming a wedge shaped pocket extending downward from the bottom of the block-shaped pocket towards the back surface of the body.

4. The method of claim 3, wherein:

forming a wedge shaped pocket comprises extending the wedge shaped pocket through the back surface of the body.

5. The method of claim 1 further comprising:

forming the neck by assembling at least two neck profiles together, at least one neck profile having a heel portion, such that when the neck profiles are assembled together, the neck is defined and at least one neck profile includes the wedge.

6. The method of claim 1 further comprising:

forming the neck by assembling three neck profiles together with a veneer strip situated between each adjacent pair of neck profiles, at least one neck profile having a heel portion, such that when the neck profiles are assembled together, the neck is defined by the neck profiles and at least one neck profile includes the wedge.

7. The method of claim 6 further comprising:

forming a middle one of the neck profiles so as to have a taper so as to be wider towards the heel and relatively more narrow towards an end opposite the heel.

8. The method of claim 6 further comprising:

attaching at least one panel to an end neck profile at an end of the neck opposite the heel to define a headstock.

9. The method of claim 1 further comprising:

forming the body out of a single piece of wood.

10. The method of claim 1, wherein:

forming a heel further comprises:

forming a compound heel by forming a block-shaped heel portion between the wedge and a fret board of the neck such that block-shaped heel portion and the wedge are stacked;

forming a heel slot further comprises:

forming a compound heel slot by:

forming a block-shaped pocket extending from the top surface of the body into but not through the body; and forming a wedge shaped pocket extending downward from the bottom of the block-shaped pocket towards the back surface of the body;

further comprising:

forming the neck by assembling three neck profiles together with a veneer strip situated between each adjacent pair of neck profiles, at least one neck profile having a heel portion, such that when the neck profiles are assembled together, the neck is defined by the neck profiles and at least one neck profile includes the wedge;

forming a middle one of the neck profiles so as to have a taper so as to be wider towards the heel and relatively more narrow towards an end opposite the heel; and attaching at least one panel to an end neck profile at an end of the neck opposite the heel to define a headstock.

11. A stringed musical instrument comprising:

a neck having a heel comprising at least a wedge extending in a length direction along a major length of the neck, having an apex pointing away from the neck along the length direction;

a body having a heel slot at a neck joint location along an upper bout of the body, the heel slot complementary to the heel of the neck and including a shaped pocket that corresponds with the wedge of the neck; wherein:

the neck is attached to the body such that the wedge engages the shaped pocket of the heel slot; and the neck is fixed to the body.

12. The stringed musical instrument of claim 11, wherein:

the heel slot extends through the back face of the body.

13. The stringed musical instrument of claim 11, wherein:

the heel further comprises:

a compound heel having a block-shaped heel portion between the wedge and a fret board of the neck such that block-shaped heel portion and the wedge are stacked;

the heel slot further comprises:

a compound heel slot having a block-shaped pocket extending from the top surface of the body into but not through the body and a wedge shaped pocket extending downward from the bottom of the block-shaped pocket towards the back surface of the body.

14. The stringed musical instrument of claim 13, wherein:

the wedge shaped pocket extends through the back surface of the body.

15. The stringed musical instrument of claim 11 wherein:

the neck comprises at least at least two neck profiles bonded together, at least one neck profile having a heel portion, such that when the neck profiles are assembled together, the neck is defined and at least one neck profile includes the wedge.

16. The stringed musical instrument of claim 11 wherein:

the neck comprises three neck profiles with a veneer strip situated between each adjacent pair of neck profiles, at least one neck profile having a heel portion, such that when the neck profiles are assembled together, the neck is defined and at least one neck profile includes the wedge.

17. The stringed musical instrument of claim 16 further comprising:

a middle one of the neck profiles has a taper so as to be wider towards the heel and relatively more narrow towards an end opposite the heel.

18. The stringed musical instrument of claim 11 further comprising:

at least one panel attached to an end neck profile at an end of the neck opposite the heel to define a headstock.

19. The stringed musical instrument of claim 11 wherein:

the body comprises a single piece of wood.

20. The stringed musical instrument of claim 11, wherein:

the heel further comprises:

a compound heel having a block-shaped heel portion between the wedge and a fret board of the neck such that block-shaped heel portion and the wedge are stacked;

the heel slot further comprises:

the compound heel slot further comprises:

a block-shaped pocket extending from the top surface of the body into but not through the body; and a wedge shaped pocket extending downward from the bottom of the block-shaped pocket towards the back surface of the body;

further comprising:

the neck comprises three neck profiles together with a veneer strip situated between each adjacent pair of neck profiles, at least one neck profile having a heel portion, such that when the neck profiles are assembled together, the neck is defined by the neck profiles and at least one neck profile includes the wedge;

a middle one of the neck profiles has a taper so as to be wider towards the heel and relatively more narrow towards an end opposite the heel; and at least one panel is attached to an end neck profile at an end of the neck opposite the heel to define a headstock.

* * * * *

UNITED STATES PATENT AND TRADEMARK OFFICE

CERTIFICATE OF CORRECTION

PATENT NO. : 8,957,291 B1
APPLICATION NO. : 14/040809
DATED : February 17, 2015
INVENTOR(S) : Gregg A. Nelson It is certified that error appears in the above-identified patent and that said Letters Patent is hereby corrected as shown below:

In the Claims

Column 9, line 46, claim 15, "comprises at least at least two" should read --comprises at least two--; and Column 10, line 29, claim 20, delete "the compound heel slot further comprises:".

Signed and Sealed this
Twenty-fifth Day of August, 2015

Michelle K. Lee

Michelle K. Lee
*Director of the United States Patent and Trademark Office*